US010610740B2

(12) United States Patent
Hayashi

(10) Patent No.: US 10,610,740 B2
(45) Date of Patent: Apr. 7, 2020

(54) GOLF BALL

(71) Applicant: Sumitomo Rubber Industries, Ltd., Kobe-shi, Hyogo (JP)

(72) Inventor: Kai Hayashi, Kobe (JP)

(73) Assignee: SUMITOMO RUBBER INDUSTRIES, LTD., Kobe-shi, Hyogo (JP)

( * ) Notice: Subject to any disclaimer, the term of this patent is extended or adjusted under 35 U.S.C. 154(b) by 0 days.

(21) Appl. No.: 16/158,751

(22) Filed: Oct. 12, 2018

(65) Prior Publication Data

US 2019/0126101 A1 May 2, 2019

(30) Foreign Application Priority Data

Oct. 31, 2017 (JP) ..... 2017-211082

(51) Int. Cl.
*A63B 37/06* (2006.01)
*A63B 37/00* (2006.01)

(52) U.S. Cl.
CPC ..... *A63B 37/0024* (2013.01); *A63B 37/004* (2013.01); *A63B 37/0022* (2013.01); *A63B 37/0074* (2013.01); *A63B 37/0075* (2013.01); *A63B 37/0092* (2013.01); *A63B 37/0031* (2013.01); *A63B 37/0035* (2013.01); *A63B 37/0037* (2013.01)

(58) Field of Classification Search
CPC ..... A63B 37/0022
USPC ..... 473/378
See application file for complete search history.

(56) References Cited

U.S. PATENT DOCUMENTS

| | | | | |
|---|---|---|---|---|
| 4,679,794 | A | 7/1987 | Yamada et al. | |
| 2003/0104880 | A1 | 6/2003 | Fushihara | |
| 2017/0056731 | A1 | 3/2017 | Tarao et al. | |
| 2017/0165527 | A1* | 6/2017 | Inoue | A63B 37/0022 |
| 2017/0173398 | A1* | 6/2017 | Tachibana | A63B 37/0022 |

FOREIGN PATENT DOCUMENTS

| | | | |
|---|---|---|---|
| JP | 61-119283 | A | 6/1986 |
| JP | 2003-52858 | A | 2/2003 |
| JP | 2003-52859 | A | 2/2003 |
| JP | 2007-143661 | A | 6/2007 |
| JP | 2012-81340 | A | 4/2012 |
| JP | 2017-42280 | A | 3/2017 |

* cited by examiner

*Primary Examiner* — Raeann Gorden
(74) *Attorney, Agent, or Firm* — Birch, Stewart, Kolasch & Birch, LLP

(57) ABSTRACT

An object of the present invention is to provide a golf ball having excellent spin performance on approach shots under a dry condition and excellent spin performance on approach shots under the condition that there is grass between the golf ball and the club face. The present invention provides golf ball comprising a golf ball body and a paint film formed on a surface of the golf ball body, wherein the paint film has a multi-layered construction composed of two or more layers, a ratio (M1/E1) of a 10% elastic modulus (kgf/cm$^2$) (M1) of an innermost layer of the paint film to a maximum elongation (%) (E1) of the innermost layer of the paint film is 10 or more and 50 or less, and the ratio (M1/E1) of the innermost layer of the paint film is greater than a ratio (M2/E2) of a 10% elastic modulus (kgf/cm$^2$) (M2) of an outermost layer of the paint film to a maximum elongation (%) (E2) of the outermost layer of the paint film.

20 Claims, 1 Drawing Sheet

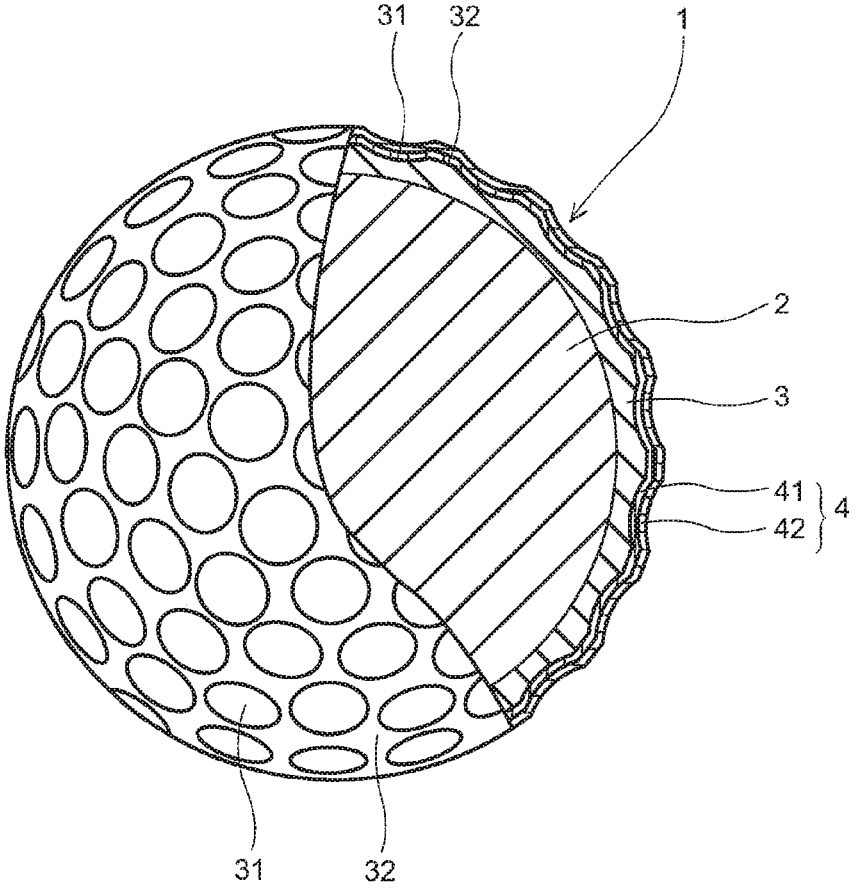
31
32
1
2
3
41
42
4
31
32

GOLF BALL

FIELD OF THE INVENTION

The present invention relates to a golf ball, particularly a golf ball comprising a paint film composed of two or more layers.

DESCRIPTION OF THE RELATED ART

A paint film is formed on a surface of a golf ball body. Conventionally, it has been proposed to improve properties of a golf ball by improving the paint film thereof.

For example, Japanese Patent Publication No. 2017-42280 A discloses a golf ball comprising a golf ball body and a paint film formed on a surface of the golf ball body, wherein the paint film has a multi-layered construction composed of two or more layers, and a difference ($M_{in}$–$M_{out}$) between a 10% elastic modulus ($M_{in}$) of an innermost layer of the paint film and a 10% elastic modulus ($M_{out}$) of an outermost layer of the paint film is 25 kgf/cm$^2$ or more.

Japanese Patent Publication No. 2012-81340 A discloses a golf ball comprising a core, a cover disposed outside the core, and a paint layer covering the cover, wherein a base polymer of the cover is a urethane resin, a base polymer of the paint layer is a urethane resin, and the paint layer is composed of two or more layers.

In addition, a golf ball having improved adhesion between a golf ball body and a paint film has also been proposed. For example, Japanese Patent Publication No. 2007-143661 A discloses a painted golf ball comprising a golf ball body; a primer layer covering a surface of the golf ball body, formed from an epoxy compound; and a paint film covering the primer layer, wherein the paint film is formed by applying a waterborne polyurethane paint.

Further, in particular, a golf ball comprising a paint film having improved adhesion to an ionomer cover has also been proposed. For example, Japanese Patent Publication No. 2003-52859 A discloses a golf ball comprising a ball body having a cover made of an ionomer resin; an epoxy resin-based clear paint film formed on the ball body by a curing reaction between a cyclic aliphatic epoxy resin and an aliphatic polyamine-based curing agent; and a urethane-based clear paint film formed on the epoxy resin-based clear paint film by a curing reaction between a polyol and an isocyanate-based curing agent. Japanese Patent Publication No. 2003-52858 A discloses a golf ball comprising a ball body having a cover made of an ionomer resin; an epoxy resin-based paint film formed on the ball body by a curing reaction between an epoxy resin and a polyamide-based curing agent; and a urethane-based clear paint film formed on the epoxy resin-based paint film by a curing reaction between a polyol and an isocyanate-based curing agent, wherein the polyol is a mixture of a polyester polyol and a polyether polyol. Japanese Patent Publication No. S61-119283 A discloses a method of applying an epoxy-based clear paint having excellent adhesion to an ionomer resin cover, followed by applying a urethane-based clear paint having excellent impact resistance and weather resistance on a surface of the epoxy-based clear paint.

SUMMARY OF THE INVENTION

However, the golf balls disclosed in the above-mentioned patent documents do not necessarily have satisfactory spin performance on approach shots, and there is still room for improvement. In addition, in the conventional technologies, the spin performance on approach shots under the condition that there is grass between the golf ball and the club face was not investigated.

The present invention has been made in view of the abovementioned circumstances, and an object of the present invention is to provide a golf ball having excellent spin performance on approach shots under a dry condition and excellent spin performance on approach shots under the condition that there is grass between the golf ball and the club face.

The present invention that has solved the above problems provides a golf ball comprising a golf ball body and a paint film formed on a surface of the golf ball body, wherein the paint film has a multi-layered construction composed of two or more layers, a ratio (M1/E1) of a 10% elastic modulus (kgf/cm$^2$) (M1) of an innermost layer of the paint film to a maximum elongation (%) (E1) of the innermost layer of the paint film is 10 or more and 50 or less, and the ratio (M1/E1) of the innermost layer of the paint film is greater than a ratio (M2/E2) of a 10% elastic modulus (kgf/cm$^2$) (M2) of an outermost layer of the paint film to a maximum elongation (%) (E2) of the outermost layer of the paint film.

According to the present invention, a golf ball having excellent spin performance on approach shots under a dry condition and excellent spin performance on approach shots under the condition that there is grass between the golf ball and the club face is obtained.

BRIEF DESCRIPTION OF THE DRAWINGS

The FIGURE is a partially cutaway sectional view showing a golf ball according to one embodiment of the present invention.

DESCRIPTION OF THE PREFERRED EMBODIMENT

The present invention provides a golf ball comprising a golf ball body and a paint film formed on a surface of the golf ball body, wherein the paint film has a multi-layered construction composed of two or more layers, a ratio (M1/E1) of a 10% elastic modulus (kgf/cm$^2$) (M1) of an innermost layer of the paint film to a maximum elongation (%) (E1) of the innermost layer of the paint film is 10 or more and 50 or less, and the ratio (M1/E1) of the innermost layer of the paint film is greater than a ratio (M2/E2) of a 10% elastic modulus (kgf/cm$^2$) (M2) of an outermost layer of the paint film to a maximum elongation (%) (E2) of the outermost layer of the paint film ((M1/E1)>(M2/E2)).

In the present invention, by adjusting the relationship between the ratio (M1/E1) of the innermost layer of the paint film and the ratio (M2/E2) of the outermost layer of the paint film, and the ratio (M1/E1) of the innermost layer of the paint film, the spin performance on approach shots under a dry condition is improved. In addition, by adjusting these parameters, grass is easily cut on shots under the condition that there is grass between the golf ball and the club face, and thus the slipping between grass and the ball is lowered, thereby improving the spin performance on approach shots under the condition that there is grass between the golf ball and the club face.

The difference ((M1/E1)−(M2/E2)) between the ratio (M1/E1) of the innermost layer of the paint film and the ratio (M2/E2) of the outermost layer of the paint film is preferably 1 or more, more preferably 10 or more, and even more preferably 30 or more, and is preferably 50 or less, more preferably 45 or less.

The ratio (M1/E1) of the 10% elastic modulus (kgf/cm$^2$) (M1) of the innermost layer of the paint film to the maximum elongation (%) (E1) of the innermost layer of the paint film is 10 or more, preferably 20 or more, more preferably 25 or more, and is preferably 50 or less, more preferably 45 or less. If the ratio (M1/E1) is less than 10, the improvement effect of the spin performance on approach shots under the condition that there is grass between the golf ball and the club face is not achieved, and if the ratio (M1/E1) exceeds 50, the paint film is excessively hard and thus the impact durability of the paint film tends to be lowered.

The maximum elongation (strain at break) (E1) of the innermost layer of the paint film is preferably 5% or more, more preferably 7% or more, even more preferably 9% or more, and most preferably 10% or more, and is preferably less than 50%, more preferably 30% or less, and even more preferably 20% or less. If the maximum elongation (E1) of the innermost layer of the paint film is 5% or more, the paint film is more flexible, occurrence of crack in the paint film is suppressed, and thus the paint film has enhanced impact durability, and if the maximum elongation (E1) of the innermost layer of the paint film is less than 50%, the spin performance on approach shots under a dry condition is enhanced. It is noted that in the case that the maximum elongation (E1) is less than 10%, the tensile strength (maximum tensile stress applied in the tensile test) is adopted as the 10% elastic modulus.

The 10% elastic modulus (tensile stress at 10% strain) (M1) of the innermost layer of the paint film is preferably 200 kgf/cm$^2$ (19.6 MPa) or more, more preferably 250 kgf/cm$^2$ (24.5 MPa) or more, and even more preferably 300 kgf/cm$^2$ (29.4 MPa) or more, and is preferably 500 kgf/cm$^2$ (49.0 MPa) or less, more preferably 450 kgf/cm$^2$ (44.1 MPa) or less. If the 10% elastic modulus (M1) of the innermost layer of the paint film is 200 kgf/cm$^2$ or more and 500 kgf/cm$^2$ or less, the spin performance on approach shots under a dry condition is enhanced.

The thickness (T1) of the innermost layer of the paint film is preferably 1 μm or more, more preferably 3 μm or more, even more preferably 5 μm or more, and most preferably 8 μm or more, and is preferably 20 μm or less, more preferably 18 μm or less, and even more preferably 15 μm or less. If the thickness (T1) of the innermost layer of the paint film is 1 μm or more and 20 μm or less, the thickness of the innermost layer of the paint film is more uniform and thus the stable spin performance is obtained. The thickness of the paint film can be obtained, for example, by measuring the cross section of the golf ball using a microscope (VHX-1000 available from Keyence Corporation).

The ratio (M2/E2) of the 10% elastic modulus (kgf/cm$^2$) (M2) of the outermost layer of the paint film to the maximum elongation (%) (E2) of the outermost layer of the paint film is preferably 0.01 or more, more preferably 0.1 or more, and even more preferably 0.4 or more, and is preferably less than 10, more preferably 5 or less, and even more preferably 3 or less. If the ratio (M2/E2) is 0.01 or more, the paint film is not excessively soft and thus the shot feeling is better, and if the ratio (M2/E2) is less than 10, the spin performance on approach shots under a dry condition is enhanced.

The maximum elongation (E2) of the outermost layer of the paint film is preferably 50% or more, more preferably 60% or more, and even more preferably 70% or more, and is preferably 500% or less, more preferably 400% or less, and even more preferably 300% or less. If the maximum elongation (E2) of the outermost layer of the paint film is 50% or more, the paint film is more flexible, occurrence of crack in the paint film is suppressed, and thus the paint film has enhanced impact durability, and if the maximum elongation (E2) of the outermost layer of the paint film is 500% or less, the paint film is not excessively soft and thus the shot feeling is better.

The 10% elastic modulus (M2) of the outermost layer of the paint film is preferably 5 kgf/cm$^2$ (0.5 MPa) or more, more preferably 10 kgf/cm$^2$ (9.8 MPa) or more, and even more preferably 20 kgf/cm$^2$ (19.6 MPa) or more, and is preferably less than 300 kgf/cm$^2$ (29.4 MPa), more preferably 200 kgf/cm$^2$ (19.6 MPa) or less, and even more preferably 100 kgf/cm$^2$ (9.8 MPa) or less. If the 10% elastic modulus (M2) of the outermost layer of the paint film is 5 kgf/cm$^2$ or more, the paint film is not excessively soft and thus the shot feeling is better, and if the 10% elastic modulus (M2) of the outermost layer of the paint film is less than 300 kgf/cm$^2$, the spin performance on approach shots under a dry condition is enhanced.

The thickness (T2) of the outermost layer of the paint film is preferably 3 μm or more, more preferably 5 μm or more, and even more preferably 8 μm or more, and is preferably 20 μm or less, more preferably 18 μm or less, and even more preferably 15 μm or less. If the thickness (T2) of the outermost layer of the paint film is 3 μm or more and 20 μm or less, the thickness of the outermost layer of the paint film is more uniform and thus the stable spin performance is obtained.

The difference (M1−M2) between the 10% elastic modulus (M1) of the innermost layer of the paint film and the 10% elastic modulus (M2) of the outermost layer of the paint film is preferably 100 kgf/cm$^2$ (9.8 MPa) or more, more preferably 200 kgf/cm$^2$ (19.6 MPa) or more, and even more preferably 300 kgf/cm$^2$ (29.4 MPa) or more, and is preferably 600 kgf/cm$^2$ (58.8 MPa) or less, more preferably 500 kgf/cm$^2$ (49.0 MPa) or less, and even more preferably 450 kgf/cm$^2$ (44.1 MPa) or less. If the difference (M1−M2) is 100 kgf/cm$^2$ or more, the spin performance on approach shots under a dry condition is enhanced, and if the difference (M1−M2) is 600 kgf/cm$^2$ or less, occurrence of delamination in the paint film having the multi-layered construction is suppressed.

The ratio (E2/E1) of the maximum elongation (%) (E2) of the outermost layer of the paint film to the maximum elongation (%) (E1) of the innermost layer of the paint film is preferably 3 or more, more preferably 5 or more, and even more preferably 7 or more, and is preferably 50 or less, more preferably 40 or less, and even more preferably 30 or less. If the ratio (E2/E1) is 3 or more, the spin performance on approach shots under a dry condition is enhanced, and if the ratio (E2/E1) is 50 or less, occurrence of delamination in the paint film having the multi-layered construction is suppressed.

In the paint film, the ratio (T1/T2) of the thickness (T1) of the innermost layer to the thickness (T2) of the outermost layer is preferably 0.1 or more, more preferably 0.2 or more, and even more preferably 0.4 or more, and is preferably 1.5 or less, more preferably 1.3 or less, and even more preferably 1.2 or less. If the ratio (T1/T2) is 0.1 or more, the innermost layer is not excessively thin and thus occurrence of delamination in the paint film is suppressed, and if the ratio (T1/T2) is 1.3 or less, the spin performance on approach shots under a dry condition is enhanced.

The number of layers of the paint film is not particularly limited, as long as the paint film has the multi-layered construction composed of two or more layers. It is noted that the multi-layered construction means a construction that two adjacent layers thereof are formed from different paints. The paint film is preferably composed of five or less layers, and particularly preferably composed of two layers.

In the case that the paint film is composed of 3 or more layers, the thickness of the layer (intermediate layer) other than the innermost layer and the outermost layer is preferably 3 μm or more, more preferably 5 μm or more, and even more preferably 8 μm or more, and is preferably 20 μm or less, more preferably 18 μm or less, and even more preferably 15 μm or less.

The ratio (M3/E3) of the 10% elastic modulus (kgf/cm$^2$) (M3) of the intermediate layer of the paint film to the maximum elongation (%) (E3) of the intermediate layer of the paint film is preferably 0.01 or more, more preferably 0.1 or more, and even more preferably 0.4 or more, and is less than preferably 10, more preferably 5 or less, and even more preferably 3 or less. The ratio (M3/E3) of the intermediate layer of the paint film is also preferably lower than the ratio (M1/E1) of the innermost layer of the paint film ((M3/E3) <(M1/E1)). In addition, the ratio (M3/E3) of the intermediate layer of the paint film is preferably greater than the ratio (M2/E2) of the outermost layer of the paint film ((M3/E3)>(M2/E2)).

The maximum elongation (E3) of the intermediate layer of the paint film is preferably 50% or more, more preferably 60% or more, and even more preferably 70% or more, and is preferably 500% or less, more preferably 400% or less, and even more preferably 300% or less.

The 10% elastic modulus (M3) of the intermediate layer of the paint film is preferably 5 kgf/cm$^2$ (0.5 MPa) or more, more preferably 10 kgf/cm$^2$ (9.8 MPa) or more, and even more preferably 20 kgf/cm$^2$ (19.6 MPa) or more, and is preferably 300 kgf/cm$^2$ (29.4 MPa) or less, more preferably 200 kgf/cm$^2$ (19.6 MPa) or less, and even more preferably 100 kgf/cm$^2$ (9.8 MPa) or less.

The total thickness (T) of all the layers of the paint film is preferably 5 μm or more, more preferably 7 μm or more, and even more preferably 10 μm or more, and is preferably 30 μm or less, more preferably 25 μm or less, and even more preferably 20 μm or less. If the total thickness (T) of all the layers of the paint film is 5 μm or more, the spin performance on approach shots under a dry condition is enhanced, and if the total thickness (T) of all the layers of the paint film is 30 μm or less, the paint film is not excessively thick and thus the paint film can be uniformly formed.

In the case that the paint film is composed of 3 or more layers, the ratio ((T1+T2)/T) of the total thickness (T1+T2) of the innermost layer and the outermost layer to the total thickness (T) of all the layers of the paint film is preferably 0.5 or more, more preferably 0.6 or more, and even more preferably 0.7 or more. It is noted that in the case that the paint film is composed of the innermost layer and the outermost layer, the ratio ((T1+T2)/T) is 1.

Various properties of the paint film can be controlled by appropriately choosing the type of the base resin constituting the paint film, and the type or amount of the components to be added therein.

Examples of the base resin constituting the paint film include at least one resin selected from the group consisting of a urethane resin, epoxy resin, acrylic resin, vinyl acetate resin, fluororesin and polyester resin. Among them, the base resin constituting the innermost layer of the paint film is preferably the epoxy resin, and the base resin constituting the outermost layer of the paint film is preferably the urethane resin. In the case that the base resin constituting the paint film is the epoxy resin, the tensile properties of the paint film can be adjusted by the type of the epoxy resin or the curing agent, and their mixing ratio thereof. In the case that the base resin constituting the paint film is the urethane resin, the tensile properties of the paint film can be adjusted by the formulation of the polyol composition or the polyisocyanate composition, and their mixing ratio thereof.

(Epoxy Paint)

The epoxy paint contains an epoxy resin and a curing agent.

The epoxy resin component is a compound having at least two epoxy groups in the molecule. Examples of the epoxy resin include a bisphenol type epoxy resin, a novolac type epoxy resin, a glycidylamine type epoxy resin, a tris(hydroxyphenyl)methane type epoxy resin, and a phenoxy type epoxy resin.

Examples of the bisphenol type epoxy resin include a bisphenol A type epoxy resin, a bisphenol F type epoxy resin, a hydrogenated product of bisphenol A type epoxy resin, a hydrogenated product of bisphenol F type epoxy resin, a bisphenol S type epoxy resin, a tetrabromobisphenol A type epoxy resin, and a bisphenol AD type epoxy resin. Examples of the novolac type epoxy resin include a phenol novolac type epoxy resin, and an o-cresol novolac type epoxy resin. Examples of the glycidylamine type epoxy resin include tetraglycidylamino diphenylmethane, triglycidyl-p-amino phenol, tetraglycidyl methaxylylene diamine, and tetraglycidyl bisaminomethyl cyclohexane. Examples of the phenoxy type epoxy resin include a bisphenol A type phenoxy resin, a bisphenol F type phenoxy resin, a phenoxy resin obtained by copolymerizing bisphenol A type and bisphenol F type, a biphenyl type phenoxy resin, a bisphenol S type phenoxy resin, and a phenoxy resin obtained by copolymerizing the biphenyl type phenoxy resin and the bisphenol S type phenoxy resin. As the epoxy resin, the bisphenol type epoxy resin is preferable, and the bisphenol A type epoxy resin is particularly preferable.

The epoxy equivalent weight (g/eq) of the epoxy resin is preferably 350 or more, more preferably 400 or more, and even more preferably 450 or more, and is preferably 600 or less, more preferably 550 or less, and even more preferably 500 or less. If the epoxy equivalent weight (g/eq) of the epoxy resin is 350 or more, the paint film is not excessively soft and thus the shot feeling is better, and if the epoxy equivalent weight (g/eq) of the epoxy resin is 600 or less, the paint film is not excessively hard and thus the impact durability is enhanced.

When the bisphenol A type epoxy resin is used as the epoxy resin, the bisphenol A type epoxy resin is preferably solid at normal temperature (25° C.). The epoxy equivalent weight (g/eq) of the solid bisphenol A type epoxy resin at normal temperature (25° C.) is preferably 350 or more, more preferably 400 or more, and even more preferably 450 or more, and is preferably 600 or less, more preferably 550 or less, and even more preferably 500 or less.

Examples of the curing agent include a polyamide amine and/or a modified product thereof; dicyandiamide; an aromatic amine having an active hydrogen, such as 4,4'-diamino diphenylmethane, 4,4'-diamino diphenylsulfone, 3,3'-diamino diphenylsulfone, m-phenylene diamine and m-xylylene diamine; an aliphatic amine having an active hydrogen, such as diethylene triamine, triethylene tetramine, isophorone diamine, bis(aminomethyl) norbornane, bis(4-aminocyclohexyl) methane and dimer acid ester of polyethyleneimine; a modified amine obtained by reacting a compound such as an epoxy compound, acrylonitrile, phenol, formaldehyde and thiourea with the above amine having the active hydrogen; tertiary amine not having an active hydrogen such as dimethyl aniline, triethylene diamine, dimethylbenzyl amine and 2,4,6-tris(dimethylaminomethyl) phenol; an imidazole such as 2-methyl imidazole and 2-ethyl-4-methyl imidazole; a carboxylic acid anhydride such as hexahydrophthalic anhydride, tetrahydrophthalic anhydride, methylhexahydrophthalic anhydride and methylnadic anhydride; a polycarboxylic acid hydrazide such as adipic acid hydrazide and naphthalene dicarboxylic acid hydrazide; a polyphenol compound such as novolac resin; a polymercaptan such as an ester of thioglycolic acid and a polyol; and a Lewis acid complex such as boron trifluoride ethylamine complex. Among them, the curing agent is preferably the amine compound, more preferably the polyamide amine and/or the modified product thereof.

The polyamide amine has a plurality of amino groups and at least one amide group. The amino group can react with the epoxy group. The polyamide amine is obtained by a condensation reaction between a polymerized fatty acid and a polyamine. The polymerized fatty acid is obtained by heating a natural fatty acid containing much unsaturated fatty acids such as linoleic acid and linolenic acid in the presence of a catalyst. Specific examples of the natural fatty acid include tall oil, soybean oil, linseed oil and fish oil. The polymerized fatty acid is preferably the one containing a dimer component in an amount of 90 mass % or more and a trimer component in an amount of 10 mass % or less, and being hydrogenated. Examples of the polyamine include polyethylene diamine, polyoxyalkylene diamine and their derivatives.

The amine equivalent weight (g/eq) of the curing agent is preferably 350 or more, more preferably 400 or more, and even more preferably 450 or more, and is preferably 650 or less, more preferably 600 or less, and even more preferably 550 or less. If the amine equivalent weight (g/eq) of the curing agent is 350 or more, the paint film is not excessively soft and thus the shot feeling is better, and if the amine equivalent weight (g/eq) of the curing agent is 650 or less, the paint film is not excessively hard and thus the impact durability is enhanced.

When the epoxy resin and the curing agent are mixed, the ratio (epoxy equivalent weight/amine equivalent weight) of the epoxy equivalent weight of the epoxy resin to the amine equivalent weight of the curing agent is preferably 0.3 or more, more preferably 0.5 or more, and even more preferably 0.7 or more, and is preferably 3.0 or less, more preferably 2.0 or less, and even more preferably 1.5 or less.

(Urethane Paint)

Examples of the urethane paint include a so-called two-component curing type urethane paint containing a polyol as a base material and a polyisocyanate as a curing agent.

(Polyol Composition)

The polyol composition contains a polyol compound. The polyol compound is a compound having at least two hydroxyl groups in the molecule thereof. Examples of the polyol compound include a compound having a hydroxyl group at the terminal of the molecule, and a compound having a hydroxyl group at a part other than the terminal of the molecule. The polyol compound may be used solely or as a mixture of at least two of them.

Examples of the compound having the hydroxyl group at the terminal of the molecule include a low molecular weight polyol having a molecular weight of less than 500 and a high molecular weight polyol having a number average molecular weight of 500 or more. Examples of the low molecular weight polyol include a diol such as ethylene glycol, diethylene glycol, triethylene glycol, 1,3-butanediol, 1,4-butanediol, neopentyl glycol, and 1,6-hexanediol; and a triol such as glycerin, trimethylolpropane, and hexanetriol. Examples of the high molecular weight polyol include a polyether polyol, a polyester polyol, a polycaprolactone polyol, a polycarbonate polyol, a urethane polyol, and an acrylic polyol.

Examples of the polyether polyol include polyoxyethylene glycol (PEG), polyoxypropylene glycol (PPG), and polyoxytetramethylene glycol (PTMG). Examples of the polyester polyol include polyethylene adipate (PEA), polybutylene adipate (PBA), and polyhexamethylene adipate (PHMA). Examples of the polycaprolactone polyol include poly-ε-caprolactone (PCL). Examples of the polycarbonate polyol include polyhexamethylene carbonate.

The urethane polyol is a compound having a plurality of urethane bonds in the molecule thereof, and having at least two hydroxyl groups in one molecule. Examples of the urethane polyol include a urethane prepolymer obtained by a reaction between a first polyol component and a first polyisocyanate component, under a condition that the hydroxyl group of the first polyol component is excessive to the isocyanate group of the first polyisocyanate component.

Examples of the first polyol component constituting the urethane polyol include a polyether diol, a polyester diol, a polycaprolactone diol, and a polycarbonate diol, and the polyether diol is preferred. Examples of the polyether diol include polyoxyethylene glycol, polyoxypropylene glycol, and polyoxytetramethylene glycol. Among them, polyoxytetramethylene glycol is preferred.

The number average molecular weight of the polyether diol is preferably 550 or more, more preferably 600 or more, and even more preferably 650 or more, and is preferably 3000 or less, more preferably 2500 or less, and even more preferably 2000 or less. If the number average molecular weight of the polyether diol is 550 or more, the distance between crosslinking points in the paint film is long and the paint film is soft, thus the spin performance is enhanced. If the number average molecular weight is 3000 or less, the distance between crosslinking points in the paint film is not excessively long and thus the stain resistance of the paint film is better. It is noted that the number average molecular weight of the polyol component can be measured, for example, by gel permeation chromatography (GPC), using polystyrene as a standard material, tetrahydrofuran as an eluate, and an organic solvent system GPC column (e.g., "Shodex (registered trademark) KF series" available from Showa Denko K.K.) as a column.

The first polyol component may include a low molecular weight polyol having a molecular weight of less than 500. Examples of the low molecular weight polyol include a diol such as ethylene glycol, diethylene glycol, triethylene glycol, 1,3-butanediol, 1,4-butanediol, neopentyl glycol, and 1,6-hexanediol; and a triol such as glycerin, trimethylolpropane, and hexanetriol. The low molecular weight polyol may be used solely or as a mixture of at least two of them.

The first polyol component constituting the urethane polyol preferably includes a triol component and a diol component. As the triol component, trimethylolpropane is preferred. The mixing ratio (triol component/diol component) of the triol component to the diol component is preferably 0.2 or more, more preferably 0.3 or more, and even more preferably 0.5 or more, and is preferably 6.0 or less, more preferably 4.0 or less, and even more preferably 2.0 or less in a mass ratio. If the triol component and the diol component used as the polyol component constituting the urethane polyol have the mixing ratio falling within the above range, the spin performance of the golf ball on approach shots is further enhanced, and the stain resistance and durability become better as well.

The first polyisocyanate component constituting the urethane polyol is not particularly limited, as long as the first polyisocyanate component has at least two isocyanate groups. Examples of the first polyisocyanate component include an aromatic polyisocyanate such as 2,4-tolylene diisocyanate, 2,6-tolylene diisocyanate, a mixture of 2,4-tolylene diisocyanate and 2,6-tolylene diisocyanate (TDI), 4,4'-diphenylmethane diisocyanate (MDI), 1,5-naphthylene diisocyanate (NDI), 3,3'-bitolylene-4,4'-diisocyanate (TODD, xylylene diisocyanate (XDI), tetramethylxylylene-diisocyanate (TMXDI), and para-phenylene diisocyanate (PPDI); an alicyclic polyisocyanate or aliphatic polyisocyanate such as 4,4'-dicyclohexylmethane diisocyanate ($H_{12}$MDI), hydrogenated xylylenediisocyanate ($H_6$XDI), hexamethylene diisocyanate (HDI), isophorone diisocyanate (IPDI), and norbornene diisocyanate (NBDI). The first polyisocyanate may be used solely or as a mixture of at least two of them.

The amount of the polyether diol in the urethane polyol is preferably 50 mass % or more, more preferably 60 mass % or more, and even more preferably 65 mass % or more. The polyether diol forms a soft segment in the paint film. Therefore, if the amount of the polyether diol is 50 mass % or more, the obtained golf ball has further enhanced spin performance.

The weight average molecular weight of the urethane polyol is preferably 3000 or more, more preferably 4000 or more, and even more preferably 4500 or more, and is preferably 10000 or less, more preferably 8000 or less, and even more preferably 6000 or less. If the weight average molecular weight of the urethane polyol is 3000 or more, the distance between crosslinking points in the paint film is long and the paint film is flexible, thus the spin performance on approach shots is enhanced. If the weight average molecular weight of the urethane polyol is 10000 or less, the distance between crosslinking points in the paint film is not excessively long and thus the stain resistance of the paint film is better.

The hydroxyl value of the urethane polyol is preferably 20 mgKOH/g or more, more preferably 30 mgKOH/g or more, and even more preferably 50 mgKOH/g or more, and is preferably 100 mgKOH/g or less, more preferably 90 mgKOH/g or less, and even more preferably 80 mgKOH/g or less. The hydroxyl value can be measured according to JIS K 1557-1, for example, by an acetylation method.

(Polyisocyanate Composition)

Next, the polyisocyanate composition will be described. The polyisocyanate composition contains a polyisocyanate compound. Examples of the polyisocyanate compound include a compound having at least two isocyanate groups.

Examples of the polyisocyanate compound include an aromatic diisocyanate such as 2,4-tolylene diisocyanate, 2,6-tolylene diisocyanate, a mixture of 2,4-tolylene diisocyanate and 2,6-tolylene diisocyanate (TDI), 4,4'-diphenylmethane diisocyanate (MDI), 1,5-naphthylene diisocyanate (NDI), 3,3'-bitolylene-4,4'-diisocyanate (TODD, xylylene diisocyanate (XDI), tetramethylxylylene diisocyanate (TMXDI), para-phenylene diisocyanate (PPDI); an alicyclic diisocyanate or aliphatic diisocyanate such as 4,4'-dicyclohexylmethane diisocyanate ($H_{12}$MDI), hydrogenated xylylenediisocyanate ($H_6$XDI), hexamethylene diisocyanate (HDI), isophorone diisocyanate (IPDI), and norbornene diisocyanate (NBDI); and a triisocyanate such as an allophanate-modified product, a biuret-modified product, an isocyanurate and an adduct of the above diisocyanate. The polyisocyanate may be used solely or as a mixture of at least two of them.

The allophanate-modified product is, for example, a triisocyanate obtained by further reacting a diisocyanate with a urethane bond formed through a reaction between a diisocyanate and a low molecular weight diol. The adduct is a triisocyanate obtained through a reaction between a diisocyanate and a low molecular weight triol such as trimethylolpropane or glycerin. The biuret-modified product is, for example, a triisocyanate having a biuret bond and represented by the following formula (1). The isocyanurate of diisocyanate is, for example, a triisocyanate represented by the following formula (2).

(1)

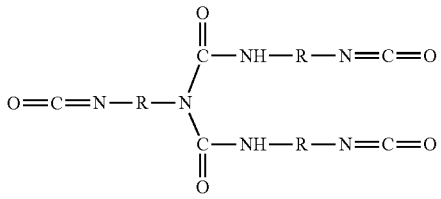

(2)

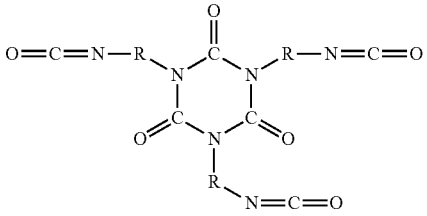

In the formulae (1) and (2), R represents a residue where the isocyanate group is removed from the diisocyanate.

The triisocyanate is preferably at least one member selected from the group consisting of isocyanurate of hexamethylene diisocyanate, biuret-modified product of hexamethylene diisocyanate and isocyanurate of isophorone diisocyanate, more preferably a mixture of these modified products. In particular, in the case that the biuret-modified product of hexamethylene diisocyanate and the isocyanurate of hexamethylene diisocyanate are used in combination, their mixing ratio (biuret-modified product/isocyanurate) preferably ranges from 0.5 to 2.0, more preferably ranges from 0.8 to 1.5, and even more preferably ranges from 0.9 to 1.4 in a mass ratio. In addition, in the case that the modified product (biuret-modified product and/or isocyanurate) of hexamethylene diisocyanate and the isocyanurate of isophorone diisocyanate are used in combination, their mixing ratio (modified product of hexamethylene diisocyanate/isocyanurate of isophorone diisocyanate) preferably ranges from 0.5 to 3.0, more preferably ranges from 0.8 to 2.5, and even more preferably ranges from 1.0 to 2.0 in a mass ratio.

The polyisocyanate composition preferably contains the triisocyanate compound as the polyisocyanate compound. The amount of the triisocyanate compound in the polyisocyanate compound of the polyisocyanate composition is preferably 60 mass % or more, more preferably 70 mass % or more, and even more preferably 80 mass % or more. The polyisocyanate compound of the polyisocyanate composition most preferably consists of the triisocyanate compound.

The amount (NCO %) of the isocyanate group of the polyisocyanate compound contained in the polyisocyanate composition is preferably 0.5 mass % or more, more preferably 1 mass % or more, and even more preferably 2 mass % or more, and is preferably 45 mass % or less, more preferably 40 mass % or less, and even more preferably 35 mass % or less. It is noted that the amount (NCO %) of the isocyanate group of the polyisocyanate can be represented by 100×[mole number of isocyanate group in polyisocyanate×42(molecular weight of NCO)]/[total mass (g) of polyisocyanate].

Specific examples of the polyisocyanate include Burnock D-800, Burnock DN-950, and Burnock DN-955 available from DIC corporation; Desmodur Z4470, Desmodur N75MPA/X, Desmodur N3300, Desmodur L75 (C), and Sumidur E21-1 available from Sumika Bayer Urethane Co., Ltd.; Coronate HX, and Coronate HK available from Nippon Polyurethane Industry Co., Ltd.; Duranate 24A-100, Duranate 21S-75E, Duranate TPA-100, and Duranate TKA-100 available from Asahi Kasei Chemicals Corporation; and VESTANAT T1890 available from Degussa Co., Ltd.

In the curing reaction of the curing type paint composition, the mass ratio (polyol composition/polyisocyanate composition) of the polyol composition to the polyisocyanate composition is preferably 3.5 or more, more preferably 4.0 or more, even more preferably 5.0 or more, and most preferably 6.0 or more, and is preferably 10.0 or less, more preferably 9.0 or less, and even more preferably 8.5 or less. If the mass ratio (polyol composition/polyisocyanate composition) of the curing type paint composition falls within the above range, the obtained paint film easily satisfies the above-mentioned various properties, thereby easily obtaining a golf ball having good spin performance on approach shots and good shot feeling as well as excellent stain resistance. On the other hand, if the mass ratio is less than 3.5, the paint film is excessively hard and thus the obtained golf ball may have unsatisfactory spin performance on approach shots and shot feeling. In addition, if the mass ratio exceeds 10.0, the paint film is excessively soft and thus the obtained golf ball may have unsatisfactory stain resistance.

In the curing reaction of the curing type paint composition, the molar ratio (NCO group/OH group) of the isocyanate group (NCO group) of the polyisocyanate composition to the hydroxyl group (OH group) of the polyol composition is preferably 0.15 or more, more preferably 0.18 or more, even more preferably 0.20 or more, and most preferably 0.22 or more, and is preferably 1.20 or less, more preferably 1.10 or less, and even more preferably 1.00 or less. If the molar ratio (NCO group/OH group) of the curing type paint composition falls within the above range, the obtained paint film easily satisfies the above-mentioned various properties, thereby easily obtaining a golf ball having good spin performance on approach shots and good shot feeling as well as excellent stain resistance. On the other hand, if the molar ratio is less than 0.15, the obtained paint film is so soft that trouble may occur in the manufacturing process. Further, if the molar ratio exceeds 1.20, the obtained paint film is so hard that the spin performance may deteriorate.

The paint may be either a waterborne paint mainly containing water as a dispersion medium or a solvent-based paint mainly containing an organic solvent as a dispersion medium, and is preferably the solvent-based paint. In the case of the solvent-based paint, examples of the preferable solvent include toluene, isopropyl alcohol, xylene, methylethyl ketone, methylisobutyl ketone, ethylene glycol monomethyl ether, ethylbenzene, propylene glycol monomethyl ether, isobutyl alcohol, ethyl acetate, and butyl acetate. It is noted that the solvent may be added in either of the polyol composition and the polyisocyanate composition, and in light of uniformly performing the curing reaction, the solvent is preferably added in the polyol composition and the polyisocyanate composition, respectively.

A conventionally known catalyst can be employed in the curing reaction. Examples of the catalyst include a monoamine such as triethyl amine and N,N-dimethylcyclohexylamine; a polyamine such as N,N,N',N'-tetramethylethylene diamine and N,N,N',N'', N''-pentamethyldiethylene triamine; a cyclic diamine such as 1,8-diazabicyclo[5.4.0]-7-undecene (DBU) and triethylene diamine; and a tin catalyst such as dibutyl tin dilaurate and dibutyl tin diacetate. These catalysts may be used solely, or two or more of the catalysts may be used in combination. Among them, the tin catalyst such as dibutyl tin dilaurate and dibutyl tin diacetate is preferred, and in particular, dibutyl tin dilaurate is preferably used.

The paint may further include additives generally included in a paint of a golf ball, such as a filler, ultraviolet absorber, antioxidant, light stabilizer, fluorescent brightener, anti-blocking agent, leveling agent, slip agent, and viscosity modifier, where necessary.

(Application Method)

Next, the method of applying the curing type paint of the present invention will be described. The method of applying the curing type paint is not particularly limited, and a conventionally known method, for example, a spray coating or an electrostatic coating, can be adopted.

In the case of performing the spray coating with an air gun, the polyol composition and the polyisocyanate composition are fed with respective pumps and continuously mixed with a line mixer located just before the air gun, and the obtained mixture is air-sprayed. Alternatively, the polyol composition and the polyisocyanate composition are air-sprayed respectively with an air spray system provided with a device for controlling the mixing ratio thereof. The paint application may be conducted by spraying the paint one time or overspraying the paint multiple times.

The curing type paint applied to the golf ball body can be dried, for example, at a temperature ranging from 30° C. to 70° C. for 1 hour to 24 hours to form the paint film.

(Golf Ball Body)

The golf ball according to the present invention is not particularly limited, as long as it is a golf ball comprising a golf ball body and a paint film formed on a surface of the golf ball body. The construction of the golf ball body is not particularly limited, and the golf ball body may be a one-piece golf ball, a two-piece golf ball, a multi-piece golf ball such as a three-piece golf ball, a four-piece golf ball, a five-piece golf ball and a golf ball comprising more than five pieces, or a wound golf ball. The present invention can be applied appropriately to any one of the above golf balls.

The FIGURE is a partially cutaway cross-sectional view showing a golf ball 1 according to one embodiment of the present invention. The golf ball 1 comprises a spherical core 2, a cover 3 covering the spherical core 2, and a paint film 4 formed on a surface of the cover 3. The paint film 4 is composed of an inner layer 41 and an outer layer 42. On the surface of the cover 3, a plurality of dimples 31 are formed. On the surface of the cover 3, a part other than the dimples 31 is a land 32.

(Core)

The one-piece golf ball body and the core used for a wound golf ball, two-piece golf ball and multi-piece golf ball will be explained.

The construction of the core is not particularly limited. The core may be either a single layered construction or a multi-layered construction composed of two or more layers, but the single layered construction is preferable. This is because unlike the multi-layered core, the single layered core does not have an energy loss at the interface of the multi-layered construction when being hit, and thus has better resilience. The core preferably has a spherical shape.

The one-piece golf ball body or the core may be formed from a conventionally known rubber composition (hereinafter sometimes simply referred to as "core rubber composition"). For example, the one-piece golf ball body or the core may be formed by heat pressing a rubber composition containing a base rubber, a co-crosslinking agent and a crosslinking initiator.

As the base rubber, particularly preferred is a high cis-polybutadiene having a cis-bond in a proportion of 40 mass % or more, more preferably 70 mass % or more, and even more preferably 90 mass % or more in view of its advantageous resilience. As the co-crosslinking agent, an α,β-unsaturated carboxylic acid having 3 to 8 carbon atoms or a metal salt thereof is preferable, and a metal salt of acrylic acid or a metal salt of methacrylic acid is more preferable. As the metal constituting the metal salt, zinc, magnesium, calcium, aluminum or sodium is preferable, and zinc is more preferable. The amount of the co-crosslinking agent is preferably 20 parts by mass or more and 50 parts by mass or less with respect to 100 parts by mass of the base rubber. In the case that the α,β-unsaturated carboxylic acid having 3 to 8 carbon atoms is used as the co-crosslinking agent, a metal compound (e.g. magnesium oxide) is preferably used in combination. As the crosslinking initiator, an organic peroxide is preferably used. Specific examples of the organic peroxide include dicumyl peroxide, 1,1-bis(t-butylperoxy)-3,3,5-trimethylcyclohexane, 2,5-dimethyl-2,5-di(t-butylperoxy)hexane, and di-t-butyl peroxide. Among them, dicumyl peroxide is preferably used. The amount of the crosslinking initiator is preferably 0.2 part by mass or more, more preferably 0.3 part by mass or more, and is preferably 3 parts by mass or less, more preferably 2 parts by mass or less, with respect to 100 parts by mass of the base rubber.

In addition, the core rubber composition may further contain an organic sulfur compound. As the organic sulfur compound, diphenyl disulfides (e.g. diphenyl disulfide, bis (pentabromophenyl)persulfide), thiophenols or thionaphthols (e.g. 2-thionaphthol) are preferably used. The amount of the organic sulfur compound is preferably 0.1 part by mass or more, more preferably 0. 3 part by mass or more, and is preferably 5.0 parts by mass or less, more preferably 3.0 parts by mass or less, with respect to 100 parts by mass of the base rubber. The core rubber composition may further contain a carboxylic acid and/or a salt thereof. As the carboxylic acid and/or the salt thereof, a carboxylic acid having 1 to 30 carbon atoms and/or a salt thereof is preferred. As the carboxylic acid, an aliphatic carboxylic acid or an aromatic carboxylic acid (e.g. benzoic acid) may be used. The amount of the carboxylic acid and/or the salt thereof is preferably 1 part by mass or more and 40 parts by mass or less with respect to 100 parts by mass of the base rubber.

The core rubber composition may further contain a weight adjusting agent such as zinc oxide and barium sulfate, an antioxidant, or a colored powder, in addition to the base rubber, the co-crosslinking agent, the crosslinking initiator, and the organic sulfur compound.

The molding conditions for heat pressing the core rubber composition may be appropriately set depending on the rubber formulation. Generally, the heat pressing is preferably carried out at 130° C. to 200° C. for 10 to 60 minutes, or carried out in a two-step heating of heating at 130° C. to 150° C. for 20 to 40 minutes followed by heating at 160° C. to 180° C. for 5 to 15 minutes.

The hardness difference (Hs−Ho) between the surface hardness Hs of the core and the center hardness Ho of the core is preferably 10 or more, more preferably 15 or more, and even more preferably 20 or more in Shore C hardness. If the hardness difference (Hs−Ho) is 10 or more, the spin rate on driver shots is lowered and the flight distance on driver shots is enhanced. In addition, the hardness difference (Hs−Ho) is preferably 50 or less, more preferably 45 or less, even more preferably 40 or less, and most preferably 35 or less in Shore C hardness. If the hardness difference (Hs−Ho) is 50 or less, the durability of the golf ball is enhanced.

The center hardness Ho of the core is preferably 40 or more, more preferably 45 or more, and even more preferably 50 or more in Shore C hardness. If the center hardness Ho of the core is 40 or more, the resilience of the golf ball is better and thus the flight distance on driver shots is enhanced. In addition, the center hardness Ho of the core is preferably 80 or less, more preferably 75 or less, and even more preferably 70 or less in Shore C hardness. If the center hardness Ho of the core is 80 or less, the shot feeling of the golf ball is enhanced.

The surface hardness Hs of the core is preferably 60 or more, more preferably 65 or more, and even more preferably 70 or more in Shore C hardness. If the surface hardness Hs of the core is 60 or more, the resilience of the golf ball is better and thus the flight distance on driver shots is enhanced. In addition, the surface hardness Hs of the core is preferably 100 or less, more preferably 95 or less, and even more preferably 90 or less in Shore C hardness. If the surface hardness Hs of the core is 100 or less, the core is not excessively hard and thus the durability is better.

The diameter of the core is preferably 37.0 mm or more, more preferably 37.5 mm or more, and even more preferably 38.5 mm or more. If the diameter of the core is 37.0 mm or more, the resilience is better. The upper limit of the diameter of the core is not particularly limited, but it is preferably 40.5 mm or less, more preferably 40.0 mm or less, and even more preferably 39.8 mm or less.

When the core has a diameter in a range from 37.0 mm to 40.5 mm, the compression deformation amount (shrinking amount along the compression direction) of the core when applying a load from 98 N as an initial load to 1275 N as a final load to the core is preferably 2.5 mm or more, more preferably 3.0 mm or more, and is preferably 4.5 mm or less, more preferably 4.0 mm or less. If the compression deformation amount is 2.5 mm or more, the shot feeling is better, and if the compression deformation amount is 4.5 mm or less, the resilience is better.

(Cover)

The golf ball body preferably comprises a core and a cover. Here, the cover means a layer (sometimes referred to as "outermost cover layer") disposed at the outermost side of the golf ball body.

The hardness of the cover is preferably 60 or less, more preferably 55 or less, even more preferably 50 or less, and most preferably 45 or less in Shore D hardness. If the harness of the cover is 60 or less in Shore D hardness, the spin rate is further enhanced. The lower limit of the hardness of the cover is not particularly limited, but it is preferably 10, more preferably 15, and even more preferably 20 in Shore D hardness. The hardness of the cover is a slab hardness obtained by measuring the cover composition for forming the cover, which has been molded into a sheet form.

The thickness of the cover is preferably 0.1 mm or more, more preferably 0.2 mm or more, and even more preferably 0.3 mm or more, and is preferably 1.0 mm or less, more preferably 0.9 mm or less, and even more preferably 0.8 mm or less. If the thickness of the cover is 0.1 mm or more, the shot feeling of the golf ball is better, and if the thickness of the cover is 1.0 mm or less, the resilience of the golf ball can be maintained.

The ratio (M4/E4) of the 10% elastic modulus (kgf/cm$^2$) (M4) of the cover to the maximum elongation (%) (E4) of the cover is preferably 0.005 or more, more preferably 0.01 or more, and even more preferably 0.02 or more, and is preferably 0.7 or less, more preferably 0.6 or less, even more preferably 0.5 or less, and most preferably 0.1 or less. The ratio (M4/E4) of the cover is preferably lower than the ratio (M1/E1) of the innermost layer of the paint film ((M4/E4) <(M1/E1)).

The maximum elongation (E4) of the cover is preferably 200% or more, more preferably 300% or more, and even more preferably 400% or more, and is preferably 800% or less, more preferably 700% or less, and even more preferably 600% or less. If the maximum elongation (E4) is 200% or more, the abrasion resistance of the cover is enhanced, and if the maximum elongation (E4) is 800% or less, the cover is not excessively soft and thus has better moldability.

The 10% elastic modulus (M4) of the cover is preferably 5 kgf/cm$^2$ (0.49 MPa) or more, more preferably 7 kgf/cm$^2$ (0.69 MPa) or more, and even more preferably 10 kgf/cm$^2$ (0.98 MPa) or more, and is preferably 30 kgf/cm$^2$ (2.94 MPa) or less, more preferably 25 kgf/cm$^2$ (2.45 MPa) or less, and even more preferably 20 kgf/cm$^2$ (1.96 MPa) or less. If the 10% elastic modulus (M4) is 5 kgf/cm$^2$ or more, the cover is not excessively soft and thus has better moldability, and if the 10% elastic modulus (M4) is 30 kgf/cm$^2$ or less, the cover is not excessively hard and thus the spin performance on approach shots is enhanced.

The difference (M1−M4) between the 10% elastic modulus (M1) of the innermost layer of the paint film and the 10% elastic modulus (M4) of the cover is preferably 100 kgf/cm$^2$ (9.8 MPa) or more, more preferably 200 kgf/cm$^2$ (19.6 MPa) or more, and is preferably 600 kgf/cm$^2$ (58.8 MPa) or less, more preferably 500 kgf/cm$^2$ (49.0 MPa) or less. If the difference (M1−M4) is 100 kgf/cm$^2$ or more, the spin performance on approach shots under a dry condition is enhanced, and if the difference (M1−M4) is 600 kgf/cm$^2$ or less, occurrence of delamination of the paint film from the cover is suppressed.

The ratio (E4/E1) of the maximum elongation (%) (E4) of the cover to the maximum elongation (%) (E1) of the innermost layer of the paint film is preferably 5 or more, more preferably 7 or more, and is preferably 100 or less, more preferably 70 or less. If the ratio (E4/E1) is 5 or more, the spin performance on approach shots under a dry condition is enhanced, and if the ratio (E4/E1) is 100 or less, occurrence of delamination in the paint film having the multi-layered construction is suppressed.

The cover preferably contains a resin component. The resin component constituting the cover is not particularly limited, and examples thereof include various resins such as an ionomer resin, a polyester resin, a urethane resin and a polyamide resin; a thermoplastic polyamide elastomer having a trade name of "Pebax (registered trademark) (e.g. "Pebax 2533")" available from Arkema Inc.; a thermoplastic polyester elastomer having a trade name of "Hytrel (registered trademark) (e.g. "Hytrel 3548" and "Hytrel 4047")" available from Du Pont-Toray Co., Ltd.; a thermoplastic polyurethane elastomer having a trade name of "Elastollan (registered trademark) (e.g. "Elastollan XNY97A")" available from BASF Japan Ltd.; and a thermoplastic styrene elastomer having a trade name of "Rabalon (registered trademark)" and a thermoplastic polyester elastomer having a trade name of "Primalloy" both available from Mitsubishi Chemical Corporation. These cover materials may be used solely, or two or more of these cover materials may be used in combination.

Among them, the resin component constituting the cover is preferably the polyurethane resin and the ionomer resin, particularly preferably the polyurethane resin. When the resin component constituting the cover includes the polyurethane resin, the amount of the polyurethane resin in the resin component is preferably 50 mass % or more, more preferably 70 mass % or more, and even more preferably 90 mass % or more. When the resin component constituting the cover includes the ionomer resin, the amount of the ionomer resin in the resin component is preferably 50 mass % or more, more preferably 70 mass % or more, and even more preferably 90 mass % or more.

The polyurethane may be either a thermoplastic polyurethane or a thermosetting polyurethane. The thermoplastic polyurethane is a polyurethane exhibiting plasticity by heating and generally means a polyurethane having a linear chain structure of a high-molecular weight to a certain extent. On the other hand, the thermosetting polyurethane (two-component curing type polyurethane) is a polyurethane obtained by polymerization through a reaction between a low-molecular weight urethane prepolymer and a curing agent (chain extender) when molding the cover. The thermosetting polyurethane includes a polyurethane having a linear chain structure or a polyurethane having a three-dimensional crosslinked structure depending on the number of the functional group of the prepolymer or the curing agent (chain extender) to be used. As the polyurethane, the thermoplastic elastomer is preferable.

Examples of the ionomer resin include a product obtained by neutralizing at least a part of carboxyl groups included in a binary copolymer composed of an olefin and an α,β-unsaturated carboxylic acid having 3 to 8 carbon atoms with a metal ion; a product obtained by neutralizing at least a part of carboxyl groups included in a ternary copolymer composed of an olefin, an α,β-unsaturated carboxylic acid having 3 to 8 carbon atoms and an α,β-unsaturated carboxylic acid ester with a metal ion; and a mixture thereof. The olefin is preferably an olefin having 2 to 8 carbon atoms. Examples of the olefin include ethylene, propylene, butene, pentene, hexene, heptene and octene, and ethylene is particularly preferred. Examples of the α,β-unsaturated carboxylic acid having 3 to 8 carbon atoms include acrylic acid, methacrylic acid, fumaric acid, maleic acid and crotonic acid, and acrylic acid or methacrylic acid is particularly preferred. In addition, examples of the α,β-unsaturated carboxylic acid ester include methyl ester, ethyl ester, propyl ester, n-butyl ester and isobutyl ester of acrylic acid, methacrylic acid, fumaric acid and maleic acid, and acrylic acid ester or methacrylic acid ester is particularly preferred. Among them, preferable examples of the ionomer resin include a metal ion-neutralized product of an ethylene-(meth)acrylic acid binary copolymer, and a metal ion-neutralized product of an ethylene-(meth)acrylic acid-(meth)acrylic acid ester ternary copolymer.

The cover may further contain a pigment component such as a white pigment (e.g. titanium oxide), a blue pigment and a red pigment, a weight adjusting agent such as calcium carbonate and barium sulfate, a dispersant, an antioxidant, an ultraviolet absorber, a light stabilizer, a fluorescent material or a fluorescent brightener, or the like, in addition to the above resin component, as long as they do not impair the performance of the cover.

The method for molding the cover from the cover composition is not particularly limited, and examples thereof include a method of injection molding the cover composition directly onto the core; and a method of molding the cover composition into hollow shells, covering the core with a plurality of the hollow shells and compression molding the core with a plurality of the hollow shells (preferably a method of molding the cover composition into half hollow-shells, covering the core with two of the half hollow-shells and compression molding the core with two of the half hollow-shells).

The concave portions called "dimple" are usually formed on the surface of the cover when molding the cover. The total number of the dimples formed on the cover is preferably 200 or more and 500 or less. If the total number of the dimples is less than 200, the dimple effect is hardly obtained, and if the total number of the dimples exceeds 500, the dimple effect is hardly obtained because the size of the respective dimples is small. The shape (shape in a plan view) of the dimples includes, for example, but is not limited to, a circle; a polygonal shape such as a roughly triangular shape, a roughly quadrangular shape, a roughly pentagonal shape, and a roughly hexagonal shape; and other irregular shape. The shape of the dimples may be employed solely, or two or more of the shapes may be employed in combination.

The golf ball body on which the cover has been formed is ejected from the mold, and as necessary, the golf ball body is preferably subjected to surface treatments such as deburring, cleaning, and sandblast. In addition, if desired, a mark may be formed thereon.

(Intermediate Layer)

The golf ball body of the present invention may further comprise at least one intermediate layer between the core and the cover. It is noted that the intermediate layer is sometimes referred to as the inner cover layer or outer core layer depending the construction of the golf ball.

The intermediate layer preferably contains a resin component. Examples of the resin component include a thermoplastic resin such as an ionomer resin, polyurethane resin, polyamide resin and polyethylene; a thermoplastic elastomer such as a styrene elastomer, polyolefin elastomer, polyurethane elastomer and polyester elastomer; a cured product of a rubber composition. Among them, the ionomer resin is preferable. Preferable examples of the ionomer resin include the ionomer resins listed as the resin component used in the cover composition. The intermediate layer may further contain a density adjusting agent such as barium sulfate and tungsten, an antioxidant, a pigment, and the like.

Examples of the method for molding the intermediate layer from the intermediate layer composition include a method of injection molding the intermediate layer composition directly onto the core; and a method of molding the intermediate layer composition into hollow shells, covering the core with a plurality of the hollow shells and compression molding the core with a plurality of the hollow shells (preferably a method of molding the intermediate layer composition into half hollow-shells, covering the core with two of the half hollow-shells and compression molding the core with two of the half hollow-shells).

The hardness of the intermediate layer is preferably 50 or more, more preferably 55 or more, and is preferably 80 or less, more preferably 70 or less in Shore D hardness. If the hardness of the intermediate layer is 50 or more, the obtained golf ball travels a greater flight distance on driver shots, and the spin rate thereof on approach shots is further increased and thus the controllability thereof is more excellent. In addition, if the hardness of the intermediate layer is 80 or less, the obtained golf ball has more excellent shot feeling and durability. It is noted that the hardness of the intermediate layer is a slab hardness obtained by measuring the intermediate layer composition which has been molded into a sheet form.

It is preferable that there exists a hardness difference between the intermediate layer and the cover. The hardness difference (intermediate layer−cover) between the intermediate layer and the cover is preferably 10 or more, more preferably 15 or more, even more preferably 20 or more, and most preferably 25 or more, and is preferably 60 or less, more preferably 50 or less, and even more preferably 40 or less in Shore D hardness. If the hardness difference between the intermediate layer and the cover falls within the above range, a synergistic effect with the improvement effect of the spin performance on approach shots by the paint film of the present invention is obtained, and thus the obtained golf ball has extremely enhanced spin performance on approach shots. In addition, the shot feeling of the golf ball is also greatly enhanced.

The Shore D hardness ratio (intermediate layer/cover) of the intermediate layer to the cover is preferably 1.1 or more, more preferably 1.2 or more, even more preferably 1.3 or more, and most preferably 1.5 or more, and is preferably 5 or less, more preferably 4 or less, and even more preferably 3 or less. If the Shore D hardness ratio of the intermediate layer to the cover falls within the above range, a synergistic effect with the improvement effect of the spin performance on approach shots by the paint film of the present invention is obtained, and thus the obtained golf ball has extremely enhanced spin performance on approach shots. In addition, the shot feeling of the golf ball is also greatly enhanced.

The thickness of the intermediate layer is preferably 0.3 mm or more, more preferably 0.4 mm or more, and even more preferably 0.5 mm or more, and is preferably 4.0 mm or less, more preferably 3.0 mm or less, even more preferably 2.5 mm or less, and most preferably 2.0 mm or less. If the thickness of the intermediate layer is 0.3 mm or more, the intermediate layer has better moldability and the obtained golf ball has further enhanced durability. In addition, if the thickness of the intermediate layer is 4.0 mm or less, the obtained golf ball has better resilience and shot feeling. It is noted that in the case of a plurality of intermediate layers, the total thickness of a plurality of intermediate layers preferably falls within the above range.

The golf ball according to the present invention preferably has a diameter in a range from 40 mm to 45 mm. In light of satisfying the regulation of US Golf Association (USGA), the diameter is particularly preferably 42.67 mm or more. In light of prevention of air resistance, the diameter is more preferably 44 mm or less, even more preferably 42.80 mm or less. In addition, the golf ball according to the present invention preferably has a mass of 40 g or more and 50 g or less. In light of obtaining greater inertia, the mass is more preferably 44 g or more, even more preferably 45.00 g or more. In light of satisfying the regulation of USGA, the mass is particularly preferably 45.93 g or less.

When the golf ball has a diameter in a range from 40 mm to 45 mm, the compression deformation amount (shrinking amount along the compression direction) of the golf ball when applying a load from 98 N as an initial load to 1275 N as a final load to the golf ball is preferably 2.0 mm or more, more preferably 2.5 mm or more, and is preferably 4.0 mm or less, more preferably 3.5 mm or less. If the compression deformation amount is 2.0 mm or more, the golf ball is not excessively hard and thus the shot feeling thereof is better. On the other hand, if the compression deformation amount is 4.0 mm or less, the resilience is greater.

EXAMPLES

Next, the present invention will be described in detail by way of examples. However, the present invention is not limited to the examples described below. Various changes and modifications without departing from the spirit of the present invention are included in the scope of the present invention.

[Evaluation Method]

Compression Deformation Amount (mm)

The deformation amount of the core or the golf ball along the compression direction (shrinking amount of the core or the golf ball along the compression direction), when applying a load from 98 N as an initial load to 1275 N as a final load to the core or the golf ball, was measured.

Core Hardness (Shore C Hardness)

The hardness measured at the surface of the core was adopted as the surface hardness of the core. In addition, the core was cut into two hemispheres and the hardness measured at the central point of the obtained cut plane was adopted as the center hardness of the core. The hardness was measured with an automatic hardness tester (Digitest II available from Bareiss company) using a detector of "Shore C".

Slab Hardness (Shore D Hardness)

Sheets with a thickness of about 2 mm were produced by injection molding the resin composition. The sheets were stored at 23° C. for two weeks. At least three of these sheets were stacked on one another so as not to be affected by the measuring substrate on which the sheets were placed, and the hardness of the stack was measured with an automatic hardness tester (Digitest II available from Bareiss company) using a detector of "Shore D".

Tensile Test of Paint Film

The tensile properties of the paint film were measured according to JIS K7161 (2014). Specifically, the base material and the curing agent were blended to prepare a paint, and the obtained paint was dried and cured at 40° C. for 4 hours to prepare a paint film (thickness: 0.05 mm). The paint film was punched into the test piece type II (width of parallel part: 10 mm, gauge length: 50 mm) prescribed in JIS K7127 (1999), to prepare a test piece. The tensile test of the test piece was conducted with a precision universal tester (Autograph (registered trademark) available from Shimadzu Corporation) under testing conditions of a length between grips: 100 mm, a tensile speed: 50 mm/min and a testing temperature: 23° C., and the tensile stress at 10% strain (10% elastic modulus) and strain at break (maximum elongation) were recorded.

Tensile Test of Cover

Sheets with a thickness of about 2 mm were produced by injection molding the resin composition. The sheets were stored at 23° C. for two weeks. According to ISO 527-1, a dumbbell shaped test piece (gauge length: 73 mm, width of parallel part: 5.0 mm) was prepared from the sheet. The properties of the test piece were measured with a tensile tester available from Shimadzu Corporation (tensile speed: 100 mm/min, testing temperature: 23° C.), and the tensile stress at 10% strain (10% elastic modulus) and strain at break (maximum elongation) were recorded.

Spin Rate on a Dry Condition

A sand wedge (trade name: CG 15 forged wedge, loft angel: 52° available from Cleveland Golf Inc.) was installed on a swing machine available from Golf Laboratories, Inc. The golf ball was hit at a head speed of 16 m/s, and the spin rate (rpm) thereof was measured by continuously taking a sequence of photographs of the hit golf ball. The measurement was conducted ten times for each golf ball, and the average value thereof was adopted as the spin rate.

Spin rate on the condition that there is grass between the golf ball and the club face A sand wedge (trade name: CG 15 forged wedge, loft angel: 52° available from Cleveland Golf Inc.) was installed on a swing machine available from Golf Laboratories, Inc. The golf ball was hit at a head speed of 16 m/s, and the spin rate (rpm) thereof was measured by continuously taking a sequence of photographs of the hit golf ball. It is noted that two leaves (length: about 3 cm) of wild grass were attached to the golf ball that was the testing object, and the golf ball was hit such that there was the wild grass between the club face and the golf ball. The measurement was conducted ten times for each golf ball, and the average value thereof was adopted as the spin rate.

[Preparation of Paint]

(1) Paint No. U1

As the paint No. U1, a two-component curing type urethane resin paint composition (Polyn #950 available from Shinto Paint Co., Ltd.) was used. The base material (a urethane polyol having a hydroxyl value of 128 mgKOH/g and made of a polyol component (trimethylolpropane and polyoxytetramethylene glycol) and a polyisocyanate component (isophorone diisocyanate), available from Shinto Paint Co., Ltd.) of Polyn #950 in an amount of 6.8 parts by mass and the curing agent of Polyn #950 in an amount of 1 part by mass were mixed to prepare the paint No. U1. It is noted that the curing agent of Polyn #950 was prepared as follows: 30 parts by mass of an isocyanurate of hexamethylene diisocyanate (Duranate (registered trademark) TKA-100 (NCO amount: 21.7 mass %) available from Asahi Kasei Chemicals Corporation), 30 parts by mass of a biuret-modified product of hexamethylene diisocyanate (Duranate 21S-75E (NCO amount: 15.5 mass %) available from Asahi Kasei Chemicals Corporation), and 40 parts by mass of an isocyanurate of isophorone diisocyanate (Desmodur (registered trademark) Z 4470 (NCO amount: 11.9 mass %) available from Bayer company) were mixed, and a mixed solvent of methyl ethyl ketone, n-butyl acetate and toluene was added therein to adjust the concentration of the polyisocyanate component to 60 mass %. In the paint No. U1, the molar ratio (NCO/OH) of the isocyanate group included in the polyisocyanate composition to the hydroxy group included in the polyol composition was 0.61. The paint film formed from the paint No. U1 has the following properties. The 10% elastic modulus was 65 kgf/cm$^2$ (6.4 MPa) and the maximum elongation was 90%.

(2) Paint No. U2

The paint No. U2 was prepared by the same method as that for preparing the paint No. U1 except that the amount of the base material of Polyn #950 was changed to 11.5 parts by mass and the amount of the curing agent of Polyn #950 was changed to 1 part by mass. In the paint No. U2, the molar ratio (NCO/OH) of the isocyanate group included in the polyisocyanate composition to the hydroxy group included in the polyol composition was 0.36. The paint film formed from the paint No. U2 has the following properties. The 10% elastic modulus was 10 kgf/cm$^2$(1.0 MPa) and the maximum elongation was 260%.

(3) Paint No. U3

The paint No. U3 was prepared by the same method as that for preparing the paint No. U1 except that the amount of the base material of Polyn #950 was changed to 3.5 parts by mass and the amount of the curing agent of Polyn #950 was changed to 11 parts by mass. In the paint No. U3, the molar ratio (NCO/OH) of the isocyanate group included in the polyisocyanate composition to the hydroxy group included in the polyol composition was 1.2. The paint film formed from the paint No. U3 has the following properties. The 10% elastic modulus was 190 kgf/cm$^2$ (18.6 MPa) and the maximum elongation was 120%.

(4) Paint No. U4

The paint No. U4 was prepared by the same method as that for preparing the paint No. U1 except that the amount of the base material of Polyn #950 was changed to 2.6 parts by mass and the amount of the curing agent of Polyn #950 was changed to 1 part by mass. In the paint No. U4, the molar ratio (NCO/OH) of the isocyanate group included in the polyisocyanate composition to the hydroxy group included in the polyol composition was 1.58. The paint film formed from the paint No. U4 has the following properties. The 10% elastic modulus was 280 kgf/cm$^2$ (27.5 MPa) and the maximum elongation was 70%.

(5) Paint No. U5

The paint No. U5 was prepared by the same method as that for preparing the paint No. U1 except that the amount of the base material of Polyn #950 was changed to 3.5 parts by mass and the curing agent of Polyn #950 was changed to an isocyanurate of tolylene diisocyanate (Desmodur IL 1451 available from Sumika Covestro Urethane Co., Ltd.) in an amount of 1 part by mass. In the paint No. U5, the molar ratio (NCO/OH) of the isocyanate group included in the polyisocyanate composition to the hydroxy group included in the polyol composition was 0.8. The paint film formed from the paint No. U5 has the following properties. The 10% elastic modulus was 330 kgf/cm$^2$ (32.4 MPa) and the maximum elongation was 13%.

(6) Paint No. U6

The paint No. U6 was prepared by the same method as that for preparing the paint No. U1 except that the amount of the base material of Polyn #950 was changed to 2.0 parts by mass and the curing agent of Polyn #950 was changed to an isocyanurate of tolylene diisocyanate (Desmodur IL 1451 available from Sumika Covestro Urethane Co., Ltd.) in an amount of 1 part by mass. In the paint No. U6, the molar ratio (NCO/OH) of the isocyanate group included in the polyisocyanate composition to the hydroxy group included in the polyol composition was 1.4. The paint film formed from the paint No. U6 has the following properties. The 10% elastic modulus was 550 kgf/cm$^2$ (53.9 MPa) and the maximum elongation was 10%.

(7) Paint No. U7

The paint No. U7 was prepared by the same method as that for preparing the paint No. U1 except that the amount of the base material of Polyn #950 was changed to 11.8 parts by mass and the amount of the curing agent of Polyn #950 was changed to 1 part by mass. In the paint No. U7, the molar ratio (NCO/OH) of the isocyanate group included in the polyisocyanate composition to the hydroxy group included in the polyol composition was 0.35. The paint film formed from the paint No. U7 has the following properties. The 10% elastic modulus was 8 kgf/cm$^2$ (0.8 MPa) and the maximum elongation was 260%.

(8) Paint No. E1

As the paint No. E1, a two-component curing type epoxy resin paint composition (Polyn #755 available from Shinto Paint Co., Ltd.) was used. The base material liquid of the paint composition is composed of a bisphenol A type epoxy resin (epoxy equivalent weight: 450 g/eq to 500 g/eq) and a solvent. The curing agent liquid of the paint composition is composed of a modified polyamide amine (amine equivalent weight: 450 g/eq to 550 g/eq) and a solvent. The mixing ratio of the base material liquid, the curing agent liquid and the thinner was adjusted such that Polyn #755 clear liquid (base material) was in an amount of 0.93 part, Polyn #755 clear liquid (curing agent) was in an amount of 1 part, and Polyn #711 thinner was in an amount of 0.8 part. The paint film formed from the paint No. E1 has the following properties. The 10% elastic modulus was 440 kgf/cm$^2$ (43.1 MPa) and the maximum elongation was 10%.

[Production of Golf Ball]

(1) Production of Core

According to the formulation shown in Table 1, the core rubber composition was kneaded, and heat-pressed in upper and lower molds, each having a hemispherical cavity, under the conditions shown in Table 1, to obtain the spherical core.

TABLE 1

| | | Core No. a |
|---|---|---|
| Rubber composition formulation (parts by mass) | Polybutadiene rubber | 100 |
| | Zinc acrylate | 35 |
| | Zinc oxide | 10 |
| | Barium sulfate | Appropriate amount*1) |
| | Dicumyl peroxide | 0.6 |
| | Benzoic acid | 2 |
| Molding condition | Temperature (° C.) | 150 |
| | Time (min) | 20 |
| Core property | Diameter (mm) | 39.7 |
| | Compression deformation amount (mm) | 3.3 |
| | Center hardness Ho (Shore C) | 50 |
| | Surface hardness Hs (Shore C) | 80 |
| | Hardness difference (Hs − Ho) (Shore C) | 30 |

*1)Barium sulfate adjustment was made such that the golf ball had a mass of 45.3 g.
Polybutadiene rubber: "BR730 (high cis-polybutadiene)" available from JSR Corporation
Zinc acrylate: "ZN-DA90S" available from Nisshoku Techno Fine Chemical Co., Ltd.
Zinc oxide: "Ginrei R" available from Toho Zinc Co., Ltd.
Barium sulfate: "Barium Sulfate BD" available from Sakai Chemical Industry Co., Ltd.
Dicumyl peroxide: "Percumyl (register trademark) D" available from NOF Corporation
Benzoic acid: available from Sigma-Aldrich Corporation (purity: at least 99.5 mass %)

(2) Preparation of Resin Composition

According to the formulations shown in Table 2, the materials were mixed with a twin-screw kneading extruder to prepare the intermediate layer resin composition and the cover resin composition in a pellet form. The extruding conditions were a screw diameter of 45 mm, a screw rotational speed of 200 rpm, and a screw L/D=35, and the mixture was heated to 200° C. to 260° C. at the die position of the extruder.

TABLE 2

| | | Resin composition No. | |
|---|---|---|---|
| | | A | B |
| Formulation (parts by mass) | Himilan 1605 | 47 | — |
| | Himilan AM7329 | 50 | — |
| | Rabalon T3221C | 3 | — |
| | Elastollan NY80A | — | 100 |
| | Ultramarine blue | 0.04 | 0.08 |
| | Barium sulfate | — | 4 |
| | Titanium oxide | 4.3 | — |
| Slab hardness (Shore D) | | 63 | 27 |
| 10% Elastic modulus (kgf/cm$^2$) | | — | 10 |
| Maximum elongation (%) | | — | 500 |
| Ratio (10% elastic modulus/maximum elongation) | | — | 0.02 |

Himilan (registered trademark) 1605: sodium ion-neutralized ethylene-methacrylic acid copolymer ionomer resin available from Du Pont-Mitsui Polychemicals Co., Ltd.
Himilan AM7329: zinc ion-neutralized ethylene-methacrylic acid copolymer ionomer resin available from Du Pont-Mitsui Polychemicals Co., Ltd.
Rabalon (registered trademark) T3221C: thermoplastic polystyrene elastomer available from Mitsubishi Chemical Corporation
Elastollan (registered trademark) NY80A: thermoplastic polyurethane elastomer available from BASF Japan Ltd.
Barium sulfate: "Barium Sulfate BD" available from Sakai Chemical Industry Co., Ltd.
Titanium oxide: A220 available from Ishihara Sangyo Kaisha, Ltd.

(3) Production of Golf Ball Body

The intermediate layer composition (resin composition No. A) obtained above was directly injection molded on the core obtained above to produce a spherical body composed of the core and the intermediate layer covering the core. Upper and lower molds for molding have a hemispherical cavity and a retractable hold pin for holding the spherical body. When molding the intermediate layer, the hold pin was protruded to hold the core charged in the mold, the intermediate layer composition heated to 260° C. was charged for 0.3 second into the mold held under a pressure of 80 tons and cooled for 30 seconds, and the mold was opened to eject the spherical body. The cover composition (resin composition No. B) in the pellet form obtained above was charged into each of the depressed part of the lower mold for molding half shells, and a pressure was applied thereto to mold half shells. The compression molding was conducted under the conditions of a molding temperature of 170° C., a molding time of 5 minutes and a molding pressure of 2.94 MPa. Two of the half shells were used to concentrically cover the spherical body obtained above, and compression molding was conducted to mold the cover. The compression molding was conducted under the conditions of a molding temperature of 145° C., a molding time of 2 minutes and a molding pressure of 9.8 MPa.

(4) Formation of Paint

The surface of the golf ball body obtained above was subjected to a sandblast treatment, and a mark was formed thereon. Then, the paint shown in Table 3 was applied to the golf ball body with a spray gun, and the paint was dried in an oven of 40° C. for 24 hours to obtain the golf ball having a mass of 45.3 g. The golf ball body was placed in a rotating member provided with three prongs, the rotating member was allowed to rotate at 300 rpm, and application of the paint was conducted by spacing a spray distance (7 cm) between the air gun and the golf ball body while moving the air gun in an up and down direction. The air gun spraying conditions were a spraying air pressure of 0.15 MPa, a compressed air tank pressure of 0.10 MPa, a painting time for one application of 1 second, an atmosphere temperature of 20° C. to 27° C., and an atmosphere humidity of 65% or less. It is noted that after the inner layer paint sprayed on the golf ball body was completely dried, the spraying of the outer layer paint was conducted. Evaluation results of the obtained golf balls are shown in Table 3.

TABLE 3

| | | | Golf ball No. | | | | | | |
|---|---|---|---|---|---|---|---|---|---|
| | | | 1 | 2 | 3 | 4 | 5 | 6 | 7 |
| Paint film | Inner layer | Paint No. | E1 | E1 | E1 | U5 | E1 | E1 | E1 |
| | | Thickness T1 (mm) | 10 | 10 | 10 | 10 | 2 | 7 | 9 |
| | | 10% Elastic modulus M1 (kgf/cm$^2$) | 440 | 440 | 440 | 330 | 440 | 440 | 440 |
| | | Maximum elongation E1 (%) | 10 | 10 | 10 | 13 | 10 | 10 | 10 |
| | | Ratio (M1/E1) | 44 | 44 | 44 | 25 | 44 | 44 | 44 |
| | Intermediate layer | Paint No. | — | — | — | — | — | — | — |
| | | Thickness T3 (mm) | — | — | — | — | — | — | — |
| | | 10% Elastic modulus M3 (kgf/cm$^2$) | — | — | — | — | — | — | — |
| | | Maximum elongation E3 (%) | — | — | — | — | — | — | — |
| | | Ratio (M3/E3) | — | — | — | — | — | — | — |
| | Outer layer | Paint No. | U1 | U7 | U4 | U1 | U1 | U1 | U1 |
| | | Thickness T2 (mm) | 10 | 10 | 10 | 10 | 9 | 9 | 9 |
| | | 10% Elastic modulus M2 (kgf/cm$^2$) | 65 | 8 | 280 | 65 | 65 | 65 | 65 |
| | | Maximum elongation E2 (%) | 90 | 260 | 70 | 90 | 90 | 90 | 90 |
| | | Ratio (M2/E2) | 0.72 | 0.03 | 4.0 | 0.72 | 0.72 | 0.72 | 0.72 |
| | Total thickness (T) | | 20 | 20 | 20 | 20 | 11 | 16 | 18 |
| | Thickness ratio (T1/T2) | | 1.0 | 1.0 | 1.0 | 1.0 | 0.2 | 0.8 | 1.0 |
| | Difference ((M1/E1) − (M2/E2)) | | 43.3 | 44.0 | 40.0 | 24.7 | 43.3 | 43.3 | 43.3 |
| | 10% Elastic modulus difference (M1 − M2) | | 375 | 432 | 160 | 265 | 375 | 375 | 375 |
| | Maximum elongation ratio (E2/E1) | | 9.0 | 26.0 | 7.0 | 6.9 | 9.0 | 9.0 | 9.0 |
| Evaluation | Spin rate under a dry condition (rpm) | | 4600 | 4650 | 4500 | 4600 | 4567 | 4580 | 4627 |
| | Spin rate under a condition that there is grass between golf ball and club face (rpm) | | 3450 | 3500 | 3400 | 3400 | 3811 | 3867 | 3788 |

| | | | Golf ball No. | | | | | |
|---|---|---|---|---|---|---|---|---|
| | | | 8 | 9 | 10 | 11 | 12 | 13 |
| Paint film | Inner layer | Paint No. | E1 | U3 | U3 | U6 | U4 | U4 |
| | | Thickness T1 (mm) | 10 | 9 | 9 | 10 | 10 | 10 |
| | | 10% Elastic modulus M1 (kgf/cm$^2$) | 440 | 190 | 190 | 550 | 280 | 280 |
| | | Maximum elongation E1 (%) | 10 | 120 | 120 | 10 | 70 | 70 |
| | | Ratio (M1/E1) | 44 | 1.6 | 1.6 | 55 | 4.0 | 4.0 |
| | Intermediate layer | Paint No. | U3 | — | — | — | — | — |
| | | Thickness T3 (mm) | 10 | — | — | — | — | — |
| | | 10% Elastic modulus M3 (kgf/cm$^2$) | 190 | — | — | — | — | — |
| | | Maximum elongation E3 (%) | 120 | — | — | — | — | — |
| | | Ratio (M3/E3) | 1.6 | — | — | — | — | — |
| | Outer layer | Paint No. | U1 | U1 | U2 | U1 | U1 | U5 |
| | | Thickness T2 (mm) | 10 | 9 | 9 | 10 | 10 | 10 |
| | | 10% Elastic modulus M2 (kgf/cm$^2$) | 65 | 65 | 10 | 65 | 65 | 330 |
| | | Maximum elongation E2 (%) | 90 | 90 | 260 | 90 | 90 | 13 |
| | | Ratio (M2/E2) | 0.72 | 0.72 | 0.04 | 0.72 | 0.72 | 25 |

TABLE 3-continued

| | | | | | | | |
|---|---|---|---|---|---|---|---|
| | Total thickness (T) | 30 | 18 | 18 | 20 | 20 | 20 |
| | Thickness ratio (T1/T2) | 1.0 | 1.0 | 1.0 | 1.0 | 1.0 | 1.0 |
| | Difference ((M1/E1) − (M2/E2)) | 43.3 | 0.9 | 1.5 | 54.3 | 3.3 | −21.4 |
| | 10% Elastic modulus difference (M1 − M2) | 375 | 125 | 180 | 485 | 215 | −50 |
| | Maximum elongation ratio (E2/E1) | 9.0 | 0.8 | 2.2 | 9.0 | 1.3 | 0.2 |
| Evaluation | Spin rate under a dry condition (rpm) | 4600 | 4200 | 4600 | 4500 | 4200 | 3700 |
| | Spin rate under a condition that there is grass between golf ball and club face (rpm) | 3420 | 3250 | 3350 | 3300 | 3300 | 3000 |

The golf balls No. 1 to 8 are the cases that the ratio (M1/E1) of the 10% elastic modulus (kgf/cm$^2$) (M1) of the innermost layer of the paint film to the maximum elongation (%) (E1) of the innermost layer of the paint film is 10 or more and 50 or less, and the ratio (M1/E1) of the innermost layer of the paint film is greater than the ratio (M2/E2) of the 10% elastic modulus (kgf/cm$^2$) (M2) of the outermost layer of the paint film to the maximum elongation (%) (E2) of the outermost layer of the paint film. These golf balls have excellent spin performance under a dry condition and excellent spin performance under a condition that grass is caught.

The golf balls No. 9 to 13 are the cases that the ratio (M1/E1) is less than 10 or more than 50. These golf balls have inferior spin performance under a dry condition and/or inferior spin performance under the condition that there is grass between the golf ball and the club face.

This application is based on Japanese Patent application No. 2017-211082 filed on Oct. 31, 2017, the contents of which are hereby incorporated by reference.

The invention claimed is:

1. A golf ball comprising a golf ball body and a paint film formed on a surface of the golf ball body, wherein the paint film has a multi-layered construction composed of two or more layers, a ratio (M1/E1) of a 10% elastic modulus (kgf/cm$^2$) (M1) of an innermost layer of the paint film to a maximum elongation (%) (E1) of the innermost layer of the paint film is 20 or more and 50 or less, and the ratio (M1/E1) of the innermost layer of the paint film is greater than a ratio (M2/E2) of a 10% elastic modulus (kgf/cm$^2$) (M2) of an outermost layer of the paint film to a maximum elongation (%) (E2) of the outermost layer of the paint film.

2. The golf ball according to claim 1, wherein a base resin of the paint film is at least one member selected from the group consisting of a urethane resin, an epoxy resin, an acrylic resin, a vinyl acetate resin, a fluororesin and a polyester resin.

3. The golf ball according to claim 1, wherein a ratio (T1/T2) of a thickness (T1) of the innermost layer of the paint film to a thickness (T2) of the outermost layer of the paint film ranges from 0.1 to 1.5.

4. The golf ball according to claim 1, wherein a ratio (E2/E1) of the maximum elongation (%) (E2) of the outermost layer of the paint film to the maximum elongation (%) (E1) of the innermost layer of the paint film ranges from 3 to 50.

5. The golf ball according to claim 1, wherein a difference (M1−M2) between the 10% elastic modulus (M1) of the innermost layer of the paint film and the 10% elastic modulus (M2) of the outermost layer of the paint film ranges from 100 kgf/cm$^2$ to 600 kgf/cm$^2$.

6. The golf ball according to claim 1, wherein the maximum elongation (E1) of the innermost layer of the paint film is 5% or more and less than 50%.

7. The golf ball according to claim 1, wherein the 10% elastic modulus (M1) of the innermost layer of the paint film ranges from 200 kgf/cm$^2$ to 500 kgf/cm$^2$.

8. The golf ball according to claim 1, wherein the ratio (M2/E2) of the outermost layer of the paint film is 0.01 or more and less than 10.

9. The golf ball according to claim 1, wherein the maximum elongation (E2) of the outermost layer of the paint film ranges from 50% to 500%, and the 10% elastic modulus (M2) of the outermost layer of the paint film is 5 kgf/cm$^2$ or more and less than 300 kgf/cm$^2$.

10. The golf ball according to claim 1, wherein a base resin of the innermost layer of the paint film is an epoxy resin, and a base resin of the outermost layer of the paint film is a urethane resin.

11. The golf ball according to claim 1, wherein the golf ball body comprises a core and a cover covering the core, and the cover has a maximum elongation (E4) ranging from 200% to 800% and a 10% elastic modulus (M4) ranging from 5 kgf/cm$^2$ to 30 kgf/cm$^2$.

12. The golf ball according to claim 11, wherein a ratio (M4/E4) of the 10% elastic modulus (kgf/cm$^2$) (M4) of the cover to the maximum elongation (%) (E4) of the cover ranges from 0.005 to 0.7.

13. The golf ball according to claim 12, wherein the ratio (M4/E4) of the cover is lower than the ratio (M1/E1) of the innermost layer of the paint film.

14. The golf ball according to claim 11, wherein a ratio (E4/E1) of the maximum elongation (%) (E4) of the cover to the maximum elongation (%) (E1) of the innermost layer of the paint film ranges from 5 to 100.

15. The golf ball according to claim 11, wherein a difference (M1−M4) between the 10% elastic modulus (M1) of the innermost layer of the paint film and the 10% elastic modulus (M4) of the cover ranges from 100 kgf/cm$^2$ to 600 kgf/cm$^2$.

16. The golf ball according to claim 1, wherein a difference ((M1/E1)−(M2/E2)) between the ratio (M1/E1) of the innermost layer of the paint film and the ratio (M2/E2) of the outermost layer of the paint film ranges from 1 to 50.

17. The golf ball according to claim 1, wherein the golf ball body comprises a core, a cover and an intermediate layer disposed between the core and the cover, and a hardness difference (intermediate layer−cover) between the intermediate layer and the cover ranges from 10 to 60 in Shore D hardness.

18. The golf ball according to claim 1, wherein the ratio (M1/E1) of the innermost layer of the paint film is 25 or more and 50 or less.

19. A golf ball comprising a golf ball body and a paint film formed on a surface of the golf ball body, wherein the paint film has a multi-layered construction composed of two or more layers, a ratio (M1/E1) of a 10% elastic modulus (kgf/cm$^2$) (M1) of an innermost layer of the paint film to a maximum elongation (%) (E1) of the innermost layer of the paint film is 10 or more and 50 or less, the ratio (M1/E1) of the innermost layer of the paint film is greater than a ratio (M2/E2) of a 10% elastic modulus (kgf/cm$^2$) (M2) of an outermost layer of the paint film to a maximum elongation (%) (E2) of the outermost layer of the paint film, and a difference ((M1/E1)−(M2/E2)) between the ratio (M1/E1) of the innermost layer of the paint film and the ratio (M2/E2) of the outermost layer of the paint film ranges from 24.7 to 50.

20. The golf ball according to claim 19, wherein the difference ((M1/E1)−(M2/E2)) between the ratio (M1/E1) of the innermost layer of the paint film and the ratio (M2/E2) of the outermost layer of the paint film ranges from 30 to 50.

* * * * *